US010456799B2

(12) United States Patent
Le Maner

(10) Patent No.: US 10,456,799 B2
(45) Date of Patent: Oct. 29, 2019

(54) FLUID PRODUCT DISPENSING DEVICE

(71) Applicant: APTAR FRANCE SAS, Le Neubourg (FR)

(72) Inventor: Francois Le Maner, La Vallee Montaure (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 16/306,666

(22) PCT Filed: Jun. 16, 2017

(86) PCT No.: PCT/FR2017/051585
§ 371 (c)(1),
(2) Date: Dec. 3, 2018

(87) PCT Pub. No.: WO2017/220901
PCT Pub. Date: Dec. 28, 2017

(65) Prior Publication Data

US 2019/0126303 A1 May 2, 2019

(30) Foreign Application Priority Data

Jun. 20, 2016 (FR) ..... 16 55696

(51) Int. Cl.
*B05B 11/00* (2006.01)
*B05B 11/02* (2006.01)

(52) U.S. Cl.
CPC ..... *B05B 11/0027* (2013.01); *B05B 11/02* (2013.01)

(58) Field of Classification Search
CPC ..... B05B 11/0027; B05B 11/02
See application file for complete search history.

(56) References Cited

U.S. PATENT DOCUMENTS 5,813,570 A * 9/1998 Fuchs ..... B05B 11/02 222/82
5,944,222 A * 8/1999 Fuchs ..... B05B 11/02 222/153.13

(Continued)

FOREIGN PATENT DOCUMENTS

DE 199 05 993 A1 8/2000
DE 102 18 782 A1 11/2003

(Continued)

OTHER PUBLICATIONS

International Search Report for PCT/FR2017/051585 dated Jan. 17, 2018 [PCT/ISA/210].

(Continued)

*Primary Examiner* — Jeremy Carroll
(74) *Attorney, Agent, or Firm* — Sughrue Mion, PLLC

(57) ABSTRACT

A fluid dispenser device comprising: a reservoir (10) containing fluid; a dispenser head (20) that is provided with a dispenser orifice (21); dispenser means (30) for dispensing at least a fraction of said fluid through said dispenser orifice (21); and passage means (40) for connecting said reservoir (10) to said dispenser orifice (21) on actuation of said dispenser means (30), said passage means (40) including a hollow needle (41) that penetrates into said reservoir (10) on actuation of said dispenser means (30), said needle (41) being fastened in a needle support (60) that is itself fastened in said dispenser head (20); said needle support (60) including blocking means (65, 66) that, in the rest position, co-operate with said reservoir (10) so as to prevent it from moving axially relative to said head (20).

8 Claims, 2 Drawing Sheets

(56) References Cited

U.S. PATENT DOCUMENTS

| | | | | |
|---|---|---|---|---|
| 6,321,942 | B1 * | 11/2001 | Krampen | B05B 15/652 222/82 |
| 6,446,839 | B1 * | 9/2002 | Ritsche | A61M 5/3158 222/153.13 |
| 6,626,379 | B1 | 9/2003 | Ritsche et al. | |
| 2005/0023295 | A1 * | 2/2005 | Tempfli | A61M 15/0028 222/135 |

FOREIGN PATENT DOCUMENTS

| | | | |
|---|---|---|---|
| EP | 0 546 607 | A1 | 6/1993 |
| EP | 1 479 450 | A2 | 11/2004 |
| FR | 2 970 955 | A1 | 8/2012 |
| WO | 03/041872 | A1 | 5/2003 |

OTHER PUBLICATIONS

International Preliminary Report on Patentability with the translation of Written Opinion dated Jan. 3, 2019 issued by the International Bureau in PCT/FR2017/051585.

* cited by examiner

FLUID PRODUCT DISPENSING DEVICE

CROSS REFERENCE TO RELATED APPLICATIONS

This application is a National Stage of International Application No. PCT/FR2017/051585 filed Jun. 16, 2017, claiming priority based on French Patent Application No. 1655696 filed Jun. 20, 2016.

The present invention relates to a fluid dispenser device.

More particularly, the present invention relates to fluid dispenser device of the single-dose or two-dose type, adapted respectively to dispense a single dose of fluid in a single actuation or two doses of fluid in two successive actuations.

In order to avoid accidental actuation of such a device, and also to accumulate sufficient energy in the user's hand to guarantee actuation that is complete, blocking means are generally provided for blocking the device in the rest position, and which the user must overcome during actuation. Typically, the blocking means are formed between the body that supports the reservoir and the dispenser head relative to which said body moves during actuation. Document EP 0 546 607 describes such a device.

That type of blocking means presents certain drawbacks. Thus, blocking is not always guaranteed reliably, in particular after the device has been transported or dropped. Furthermore, when the blocking means comprise breakable bridges, this requires the body and the head to be co-molded, and can turn out to be complex and expensive. Breakable bridges between the body and the head also occupy a non-negligible amount of space radially, and this is detrimental to the compactness of the device. That embodiment also prevents providing tear-off protection means between the same two pieces and distinct from said breakable bridges so as to protect the integrity of the reservoir and prevent access to the fluid that it contains.

Documents DE 199 05 993, U.S. Pat. No. 6,626,379, DE 102 18 782, and EP 1 479 450 describe prior-art devices.

An object of the present invention is to provide a fluid dispenser device that does not have the above-mentioned drawbacks.

More particularly, an object of the present invention is to provide a fluid dispenser device that provides reliable blocking before actuation.

Another object of the present invention is to provide such a device that combines blocking means comprising breakable bridges and tear-off protection means that are distinct from said breakable bridges.

Another object of the present invention is to provide such a device that is compact and that does not take up much space, in particular in its radial dimension.

Another object of the present invention is to provide such a device that is simple and inexpensive to manufacture and to assemble.

The present invention thus provides a fluid dispenser device comprising: a reservoir containing fluid; a dispenser head that is provided with a dispenser orifice; dispenser means for dispensing at least a fraction of said fluid through said dispenser orifice; and passage means for connecting said reservoir to said dispenser orifice on actuation of said dispenser means, said passage means including a hollow needle that penetrates into said reservoir on actuation of said dispenser means, said needle being fastened in a needle support that is itself fastened in said dispenser head; said needle support including blocking means that, in the rest position, co-operate with said reservoir so as to prevent it from moving axially relative to said head.

Advantageously, said blocking means are deactivated when the user exerts an axial actuation force that is greater than a predetermined threshold, between said reservoir and said dispenser head.

Advantageously, said blocking means comprise a blocking element that is connected to said needle support via at least one breakable bridge.

Advantageously, said blocking element is a radial ring that is connected to said needle support via a plurality of breakable bridges.

Advantageously, said dispenser means comprise a stopper/piston that, in the rest position, closes said reservoir in leaktight manner, and that during actuation is initially pierced by said needle, then moved axially in said reservoir so as to expel the fluid through said needle towards said dispenser orifice.

Advantageously, said device includes actuator means for actuating said dispenser means, said actuator means comprising a body that receives said reservoir in stationary manner, said body being able to slide axially relative to said dispenser head.

Advantageously, the device includes tear-off protection means that are arranged between said body of said actuator means and said dispenser head.

Advantageously, said tear-off protection means comprise an outwardly-directed radial shoulder that is formed on said body, and an inwardly-directed radial shoulder that is formed on said dispenser head, the inside diameter of said inwardly-directed radial shoulder being smaller than the outside diameter of said outwardly-directed radial shoulder.

These characteristics and advantages and others of the present invention appear more clearly from the following detailed description, given by way of non-limiting examples, and with reference to the accompanying drawings, and in which.

Figure 1:
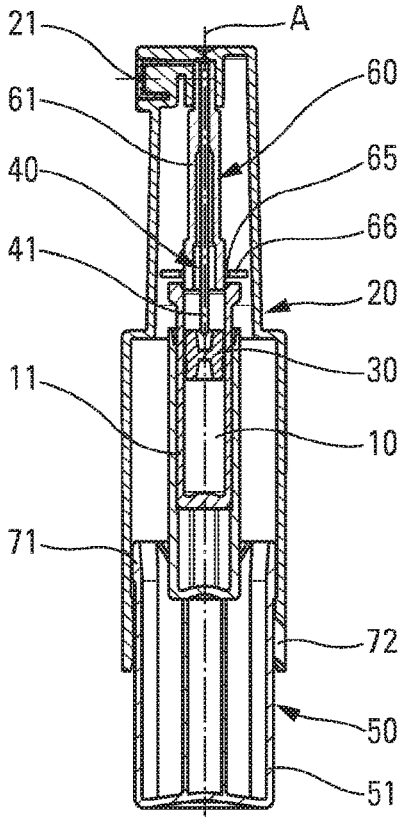
FIG. 1 is a diagrammatic side view in section of a fluid dispenser device in an advantageous embodiment of the present invention, in its rest position before actuation.

In the description, the terms "axial" and "radial" are relative to the longitudinal axis A of the device shown in FIGS. 1 to 4. The terms "top" and "bottom" are relative to the position of the device in FIGS. 1 to 4.

With reference to the figures, the device includes a reservoir 10 containing fluid to be dispensed, typically a liquid. The reservoir 10 is arranged inside a body that forms a dispenser head 20. The dispenser head 20 includes a dispenser orifice 21 that is oriented radially in the embodiment in FIGS. 1 to 4. The dispenser orifice 21 serves to dispense a dose of fluid out from said dispenser head 20. In a variant, the dispenser orifice could be oriented axially, in particular in a nasal dispenser head.

In this embodiment, the reservoir 10 is formed by a body 11 that is hollow and blind, including a single opening that is closed by a stopper/piston 30. Other embodiments are possible, e.g. a reservoir that is open at both ends, with a respective stopper for closing each opening. Documents WO 03/041872 and FR 2 970 955 describe reservoirs of this type.

The dispenser head 20 includes passage means 40 that, during actuation, connect the reservoir 10 to the dispenser orifice 21. The passage means 40 include a needle 41 that is adapted to pierce the stopper/piston 30 at the time of actuation. The needle 41 is hollow and may be formed in conventional manner. The needle 41 is stationary relative to the dispenser head 20, and in particular relative to the dispenser orifice 21.

Figure 6:
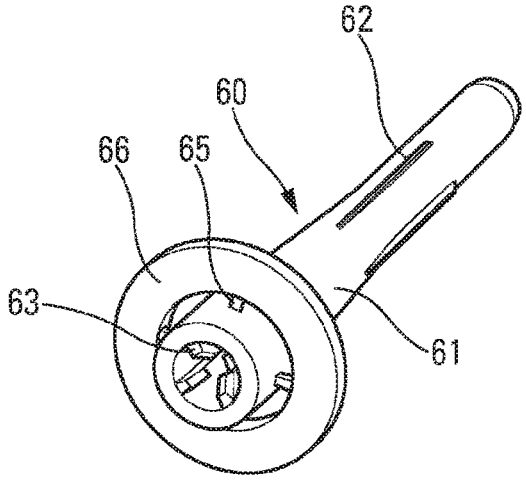
FIG. 6 is a perspective view of the needle support in FIGS. 1 to 4.

The needle 41 is fastened in a needle support 60 that is itself fastened, in particular force-fitted, in the dispenser head 20. The needle support 60 advantageously comprises a hollow body 61 that is approximately cylindrical, and in which said needle 41 comes to be fastened. Advantageously, internal axial splines 63 are provided inside said hollow body 61 so as to center and fasten said needle 41. External axial splines 62 may also be provided on said hollow body 61, as can be seen in FIG. 6, having a function that is described below.

Actuator means 50 are provided so as to make it possible to actuate the device. Specifically, the actuator means 50 comprise a body 51 that is movable relative to the dispenser head 20, said body 51 co-operating with said reservoir 10 so as to move it relative to the dispenser head 20 and thus relative to the needle 41.

In conventional manner, in the device shown in FIGS. 1 to 4, the user places two fingers on the radial bearing surfaces 22 that are formed on the dispenser head 20, and presses with the thumb on said actuator body 51. During such actuation, the reservoir 10 is thus urged axially upwards, so that the needle 41 pierces the stopper/piston 30. The contents of the reservoir 10 are thus connected to the dispenser orifice 21, and the user pressing on the actuator means 50 moves the stopper/piston 30 in the reservoir 10 so as to dispense the fluid. The stopper/piston 30 thus acts as a piston, forcing the fluid out from said reservoir 10, through the needle 41.

For a single-dose device, all of the fluid is dispensed in a single actuation, whereas for a two-dose device, two successive actuations are necessary.

In the invention, the needle support 60 includes blocking means 65, 66 that, in the rest position, co-operate with the reservoir 10 so as to prevent it from moving axially relative to the head 20. When the user wishes to actuate the device, the blocking means must initially be overcome.

Figure 7:
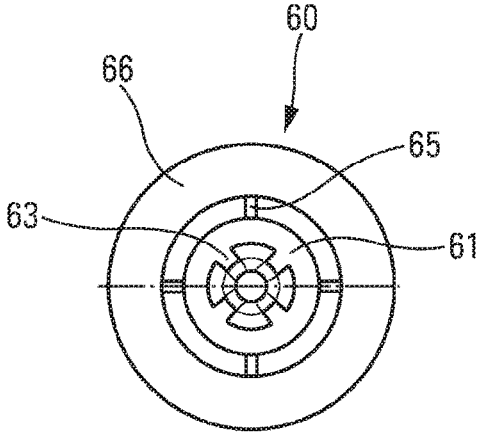
FIG. 7 is a view from below of the needle support.

As can be seen more clearly in FIGS. 6 and 7, the blocking means comprise a blocking element 66 that is connected to the hollow body 61 of the needle support 60 via at least one breakable bridge 65.

In the embodiment shown, the blocking element is advantageously made in the shape of a radial ring 66, and there are four breakable bridges 65. However, any number of breakable bridges can be envisaged.

In a variant, the blocking element could be made in some other way. In particular, there could be a plurality of separate blocking elements 66, each connected to said hollow body via a respective breakable bridge 65.

In particular, the blocking means of the present invention are advantageous in that they are simple and thus inexpensive to manufacture, in particular to mold, and to assemble.

Figure 2:
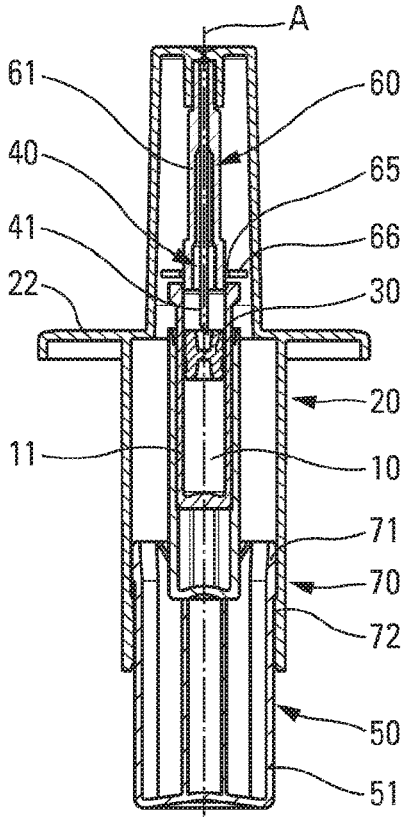
FIG. 2 is a view similar to the view in FIG. 1, as seen from the rear.
Figure 5:
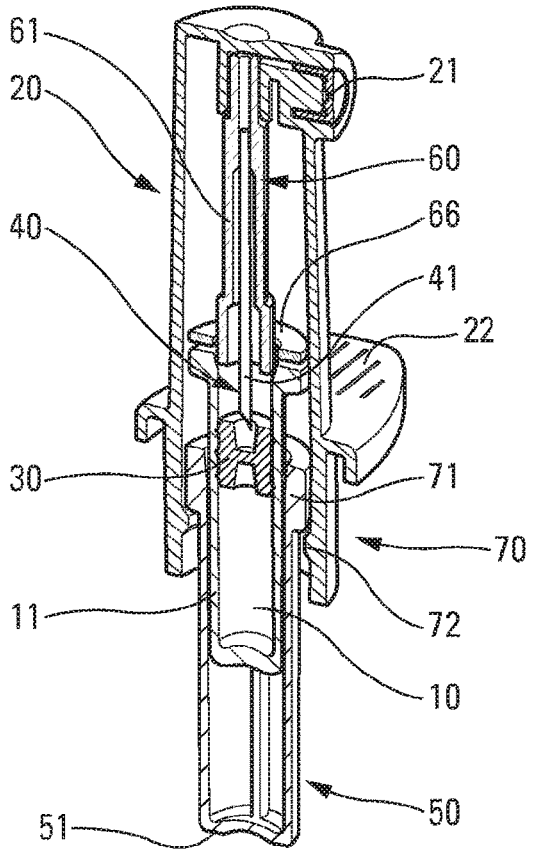
FIG. 5 is a cut-away perspective view of a fluid dispenser device in a variant embodiment of the present invention, in its rest position before actuation.

When the user wishes to actuate the device, the user exerts an axial force between the body 51 of the actuator means 50 and the radial bearing surfaces 22 of the dispenser head 20. The body 51, and thus the reservoir 10, cannot move axially relative to the head 2 as a result of the blocking means that co-operate with the top edge of the reservoir, as can be seen in FIGS. 1, 2, and 5.

Figure 3:
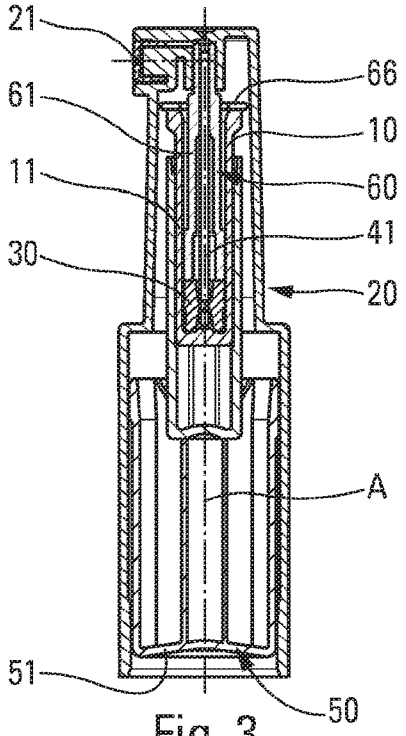
FIG. 3 is a view similar to the view in FIG. 1, showing the device after actuation.
Figure 4:
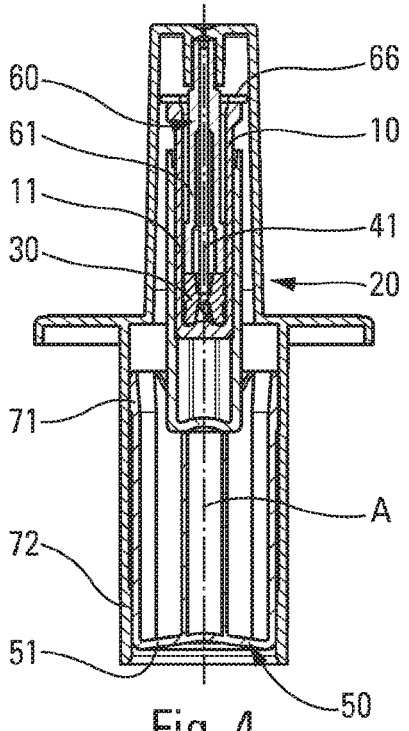
FIG. 4 is a view similar to the view in FIG. 2, showing the device after actuation.

When the axial force reaches a predetermined threshold, the breakable bridges 65 break, thereby enabling said blocking element 66 to slide axially around the hollow body 61 of the needle support 60. Simultaneously, the body 51 and the reservoir 10 also move axially relative to the dispenser head 20, causing the stopper/piston 30 to be pierced by the needle 41, then said stopper/piston 30 to move in the reservoir so as to expel the fluid. FIGS. 3 and 4 show the device after actuation, with the blocking element 66 at the top of said hollow body 61. The splines 62 may serve to block said blocking element 66 after actuation, e.g. by clamping or by snap-fastening.

Said predetermined threshold of the axial actuation force at which the breakable bridges break guarantees pre-compression of the user's hand, which guarantees that, when said breakable bridges break, the actuation stroke is performed in full. The threshold may be selected so as to guarantee good anti-actuation safety during transport and storage, while nevertheless enabling actuation that is not too difficult.

The device advantageously includes tear-off protection means 70 that are arranged between the body 51 of the actuator means 50 and the dispenser head 20, so as to prevent the user from having easy access to the fluid contained in the reservoir 10.

In the embodiment shown, the tear-off protection means comprise an outwardly-directed radial shoulder 71 that is formed on the body 51 and an inwardly-directed radial shoulder 72 that is formed on the dispenser head, the inside diameter of said inwardly-directed radial shoulder 72 being smaller than the outside diameter of said outwardly-directed radial shoulder 71. Thus, in the rest position, shown in FIGS. 1, 2, and 5, the inwardly-directed radial shoulder 72 that is formed on the head 20 prevents the body 51, and thus the reservoir 10, from being removed from the device.

As can be seen in the figures, as a result of positioning the blocking means at the needle support 60, it is possible to make a device that is provided with blocking means and tear-off protection means that are both effective, and to present radial dimensions that are as small as possible.

Naturally, other embodiments may also be envisaged, without going beyond the ambit of the present invention, as defined by the accompanying claims.

The invention claimed is:

1. A fluid dispenser device comprising: a reservoir (10) containing fluid; a dispenser head (20) that is provided with a dispenser orifice (21); dispenser means (30) for dispensing at least a fraction of said fluid through said dispenser orifice (21); and passage means (40) for connecting said reservoir (10) to said dispenser orifice (21) on actuation of said dispenser means (30), said passage means (40) including a hollow needle (41) that penetrates into said reservoir (10) on actuation of said dispenser means (30), said needle (41) being fastened in a needle support (60) that is itself fastened in said dispenser head (20); the dispenser device being characterized in that said needle support (60) includes blocking means (65, 66) that, in the rest position, co-operate with said reservoir (10) so as to prevent it from moving axially relative to said head (20).

2. A device according to claim 1, wherein said blocking means (65, 66) are deactivated when the user exerts an axial actuation force that is greater than a predetermined threshold, between said reservoir (10) and said dispenser head (20).

3. A device according to claim 1, wherein said blocking means (65, 66) comprise a blocking element (66) that is connected to said needle support (60) via at least one breakable bridge (65).

4. A device according to claim 3, wherein said blocking element (66) is a radial ring that is connected to said needle support (60) via a plurality of breakable bridges (65).

5. A device according to claim 1, wherein said dispenser means (30) comprise a stopper/piston (30) that, in the rest position, closes said reservoir (10) in leaktight manner, and that during actuation is initially pierced by said needle (41), then moved axially in said reservoir (10) so as to expel the fluid through said needle (41) towards said dispenser orifice (21).

6. A device according to claim 5, wherein said device includes actuator means (50) for actuating said dispenser means (30), said actuator means (50) comprising a body (51) that receives said reservoir (10) in stationary manner, said body (51) being able to slide axially relative to said dispenser head (20).

7. A device according to claim 6, including tear-off protection means (70) that are arranged between said body (51) of said actuator means (50) and said dispenser head (20).

8. A device according to claim 7, wherein said tear-off protection means (70) comprise an outwardly-directed radial shoulder (71) that is formed on said body (51), and an inwardly-directed radial shoulder (72) that is formed on said dispenser head (20), the inside diameter of said inwardly-directed radial shoulder (72) being smaller than the outside diameter of said outwardly-directed radial shoulder (71).

* * * * *